US011771974B1

(12) United States Patent
Selby

(10) Patent No.: US 11,771,974 B1
(45) Date of Patent: Oct. 3, 2023

(54) SYSTEMS AND METHODS FOR GOLF SWING TRAINING

(71) Applicant: Impacteez, LLC, Scottsdale, AZ (US)

(72) Inventor: Nolan Selby, Scottsdale, AZ (US)

(73) Assignee: Impacteez, LLC, Scottsdale, AZ (US)

( * ) Notice: Subject to any disclaimer, the term of this patent is extended or adjusted under 35 U.S.C. 154(b) by 0 days.

(21) Appl. No.: 17/901,472

(22) Filed: Sep. 1, 2022

(51) Int. Cl.
*A63B 69/36* (2006.01)

(52) U.S. Cl.
CPC ..... *A63B 69/3623* (2013.01); *A63B 2214/00* (2020.08)

(58) Field of Classification Search
CPC ..... A63B 69/3623; A63B 2214/00
USPC ..... 473/257, 265, 268, 392
See application file for complete search history.

(56) References Cited

U.S. PATENT DOCUMENTS 2,219,732 A * 10/1940 Armstrong ..... A63B 57/10 473/392
3,853,325 A * 12/1974 Easterbrook ..... A63B 69/3623 473/268
4,302,014 A * 11/1981 Shull ..... A63B 69/0059 473/274
4,869,510 A * 9/1989 Battersby ..... A63B 69/3621 473/409
5,375,844 A * 12/1994 Waud ..... A63B 69/3629 473/268
5,591,090 A * 1/1997 Kauffman, Jr. .... A63B 69/3623 473/271
9,757,638 B1 * 9/2017 Orfe ..... A63B 57/10
2010/0009769 A1 * 1/2010 Kimball ..... A63B 69/3621 473/257
2010/0298060 A1 * 11/2010 MacDonald ..... A63B 60/00 473/409

* cited by examiner

*Primary Examiner* — Nini F Legesse
(74) *Attorney, Agent, or Firm* — Gavvel, LLC; Peter L. Krehbiel

(57) ABSTRACT

A golf swing training device may comprise a first elongate member and a second elongate member each coupled at and extending orthogonally from a junction, wherein the second elongate member is shorter than the first elongate member, wherein a distal end of the second elongate member is sharply tapered to a point.

10 Claims, 3 Drawing Sheets

SYSTEMS AND METHODS FOR GOLF SWING TRAINING

FIELD

The disclosure relates generally to sports training devices and, more particularly, to training devices for providing instantaneous feedback of golf ball strike geometry.

BACKGROUND

Golf is a highly technical sport wherein a small variance in swing, equipment, or technique can result in a large variance in the results achieved by the player. For most golfers, from beginner to professional, achieving consistent impact and thus controlling ball flight is a key aim. Many factors influence impact and ball flight and one of these factors is the complex interaction between the ground, the ball, and the golf club as it strikes the ball. These variances may be further amplified when striking the ball from a tee.

SUMMARY

In various embodiments the present disclosure provides a golf swing training device comprising a first elongate member and a second elongate member each coupled at and extending orthogonally from a junction, wherein the second elongate member is shorter than the first elongate member, wherein a distal end of the second elongate member is sharply tapered to a point.

In various embodiments, the ratio of the length of the first elongate member to the second elongate member is about 1:1.2. In various embodiments, an interior angle defined by the intersection between the center lines of first elongate member and the second elongate member is between 85° and 95°. In various embodiments, a flanged portion projects radially from the second elongate member. In various embodiments, the flanged portion includes a frustoconical portion. In various embodiments, the flanged portion is removable. In various embodiments, the flanged portion is traversable along the second elongate member in response to a traversing force. In various embodiments, the second elongate member comprises a detent. In various embodiments, the junction includes a web portion extending between the first elongate member and the second elongate member. In various embodiments, the junction includes a frangibility feature. In various embodiments, the frangibility feature includes at least one of a cutout portion or a shear line. In various embodiments, in response to applying an impact force to the first elongate member, the first elongate member is separated from the junction with the second elongate member by shearing at the frangibility feature.

In various embodiments, the present disclosure provides golf swing training device comprising a first elongate member and a second elongate member each coupled at and extending orthogonally from a junction, wherein the second elongate member is shorter than the first elongate member, wherein the second elongate member comprises a flanged portion projecting radially from the second elongate member, wherein each of the first elongate member, the second elongate member, the junction, and the flanged portion are monolithic.

In various embodiments, he flanged portion includes a frustoconical portion. In various embodiments, the junction includes a web portion extending between the first elongate member and the second elongate member. In various embodiments, the junction includes a frangibility feature. In various embodiments, in response to applying an impact force to the first elongate member, the first elongate member is separated from the junction with the second elongate member by shearing at the frangibility feature. In various embodiments, first elongate member comprises one of a circular cross section, an elliptical cross section, a lenticular cross section, or a rectangular cross section.

In various embodiments, the present disclosure provides a method of providing golf swing feedback, the method comprising aligning a first elongate member of a swing training device above a golf ball, selecting a desired height of the first elongate member above the golf ball, applying an insertion force to the second the second elongate member the swing training device and, in response, inserting a distal end of the second elongate member below a substrate and removing the insertion force in response to at least one of a tactile feedback, a visual feedback, or contacting a flanged portion with the substrate. In various embodiments, the method includes applying an impact force to the first elongate member and, in response to the impact force, shearing the first elongate member from a junction between the first elongate member and the second elongate member.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosures, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration and their best mode. While these exemplary embodiments are described in sufficient detail to enable those skilled in the art to practice the disclosures, it should be understood that other embodiments may be realized and that logical, chemical, and mechanical changes may be made without departing from the spirit and scope of the disclosures. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
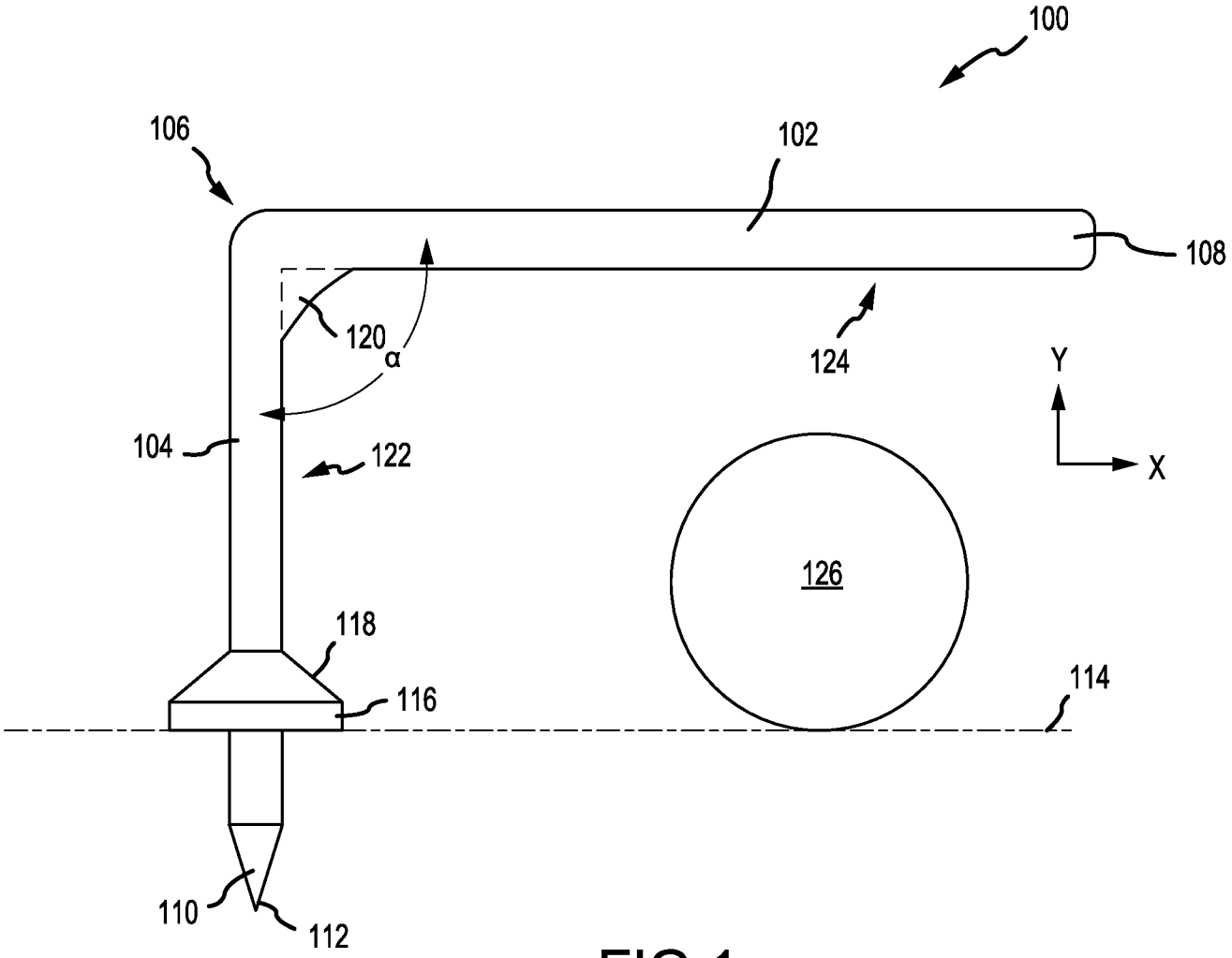
FIG. 1 illustrates a golf swing training device, in accordance with various embodiments.

Referring now to FIG. 1, in accordance with various embodiments, a golf swing training device 100 is illustrated. Swing training device 100 comprises a first elongate member 102 and a second elongate member 104 coupled at and extending orthogonally from junction 106. The junction 106 is defined at the intersection of the center lines of first and second elongate members (102, 104). In this regard, the first elongate member 102 has an end 108 distal of the junction 106 the second elongate member 104 has an end 110 distal of the junction 106. In various embodiments the interior angle $\alpha$ of the intersection between the center lines of the elongate members (102, 104) may be 90°, or may be between 89° and 91°, or may be between 85° and 91°, or may be between 85° and 95°, or may be between 90° and 45°. In various embodiments, junction 106 may include a web portion 120 extending between the first and second elongate members (102, 104). In this regard, the web portion 120 may tend to increase the strength of the junction 106. In various embodiments, the first elongate member 102, the second elongate member 104, and the junction 106 may be monolithic. In various embodiments, the first elongate member 102, the second elongate member 104, and the junction 106 may comprise at least one of a metallic material, a plastic material, a thermoplastic material, a plant based material, and/or a biodegradable plastic material.

In various embodiments, the second elongate member is shorter than the first elongate member. For example, the ratio of the length of the first elongate member to the second elongate member may be about 1:1.2 where about in this context means±0.1. In various embodiments the first elongate member may be about 5.5 inches (13.9 cm) and the second elongate member may be about 4.5 inches (10.2 cm) where about in this context means±1.5 inches (3.8 cm).

In various embodiments, the first elongate member 102 may include markings 124 configured to provide a reference for placement of the golf ball 126 below the first elongate member 102. Markings 124 may comprise, for example, colored bands, numbers, embossing, and/or the like. For example, markings 124 may comprise a colored band corresponding to the diameter of the golf ball 126 or may comprise an arrow indicating a center point of the golf ball 126.

In various embodiments, the first elongate member 102 and/or the second elongate member 104 may comprise a constant cross section. The cross section may be, for example, a circular cross section, an elliptical cross section, a lenticular cross section, a rectangular cross section, and or the like. In various embodiments, the diameter of the first elongate member 102 may differ from that of the second elongate member 104. For example, the ratio of the diameter of the first elongate member 102 to the second elongate member 104 may be 1:2. In various embodiments, the first elongate member 102 and/or the second elongate member 104 may taper in extent away from the junction 106 toward the respectively distal end (108, 110). In various embodiments, the end 110 of the second elongate member 104 may be sharply tapered to a point 112. In this regard, the point 112 may facilitate inserting end 110 of the second elongate member 104 into the earth below ground level (dashed line 114).

In various embodiments, the second elongate member 104 may include markings 122 at various stations along the extent of the second elongate member 104 to indicate the height of the first elongate member 102 above a reference plane such as ground level (dashed line 114). Markings 122 may comprise, for example, colored bands, numbers, embossing, and/or the like. Markings 122 may indicate the height of the first elongate member 102 when placed above a golf ball 126 resting on the reference plane and/or may indicate the insertion depth of the end 110 below ground level. In this regard the user may, in response to observing the markings 122 while applying an insertion force to the second elongate member 104, adjust the height of the first elongate member 102 above the golf ball 126 placed under the first elongate member 102. For example, the marking may indicate an insertion depth of 1.5 inches (3.8 cm), 2 inches (5.1 cm), 2.5 inches (6.4 cm) and/or the like. In various embodiments the markings 122 may comprise a first colored band, a second colored band, and a third colored band each corresponding respectively to the selected height and/or a skill level of the user (e.g., beginner, intermediate, expert and/or the like).

In various embodiments a flanged portion 116 may project radially from the second elongate member 104 proximate the end 110. In response to end 110 being inserted below ground level 114, the flanged portion 116 may contact the ground and generate an interference at the flanged portion 116. In response to the interference between the ground and the flanged portion 116, the second elongate member 104 may be inhibited from being further inserted below ground level 114. In various embodiments, the flanged portion 116 may include a frustoconical portion 118. In various embodiments, the frustoconical portion 118 may tend to increase the strength of the flanged portion 116 and thereby further inhibit further insertion of the second elongate member 104 below the ground level 114.

Figure 2:
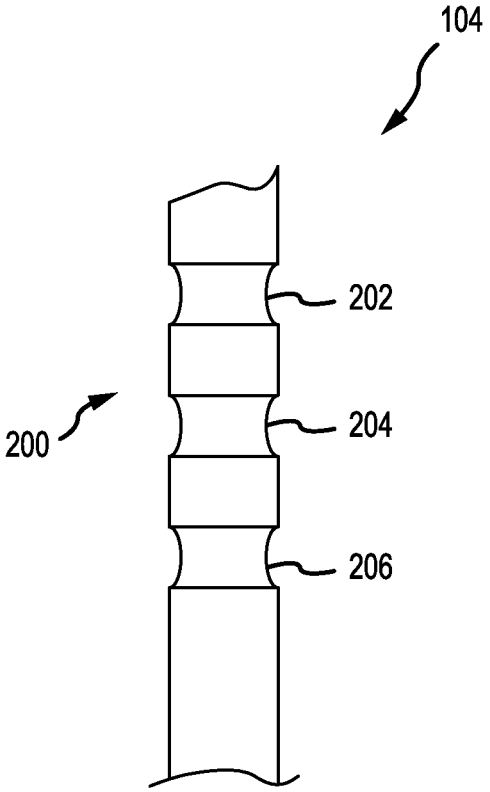
FIG. 2 illustrates a second elongate member of a golf swing training device, in accordance with various embodiments.

In various embodiments the flanged portion 116 may be monolithic with the second elongate member 104. In various embodiments, the flanged portion 116 may be removable and/or configured traverse along the second elongate member 104 in response to a traversing force applied to the flanged portion. With additional reference to FIG. 2, second elongate member 104 is illustrated comprising a plurality of detents 200. The flanged portion may be traversed along the second elongate member 104 and tend to be captured by the detents. For example, the flanged portion may be captured at a first detent 202. To further traverse the flanged portion 116, the traversing force may be increased to overcome the interference generated by the first detent 202 thereby enabling the flanged portion to travers to a second detent 204 or a third detent 204. By positioning the flanged portion 116 at the first detent 202, the second detent 204, or the third detent 206, the user may adjust the distance between the first elongate member 102 and the ground level 114. In this regard, the user may, in response to contacting the flanged portion with the ground level 114, adjust the height of the first elongate member 102 above the golf ball 126 placed under the first elongate member 102.

In various embodiments, the detents (202, 204, 206) may provide a tactile feedback reference when inserting the second elongate member 104 below the ground level 114. The insertion force may vary in response to the interface between the ground and the detents (202, 204, 206). For example, the insertion force may tend to decrease at the interface with a detent tending thereby to indicate to the user a point at which to remove the insertion force. In this regard, the user may, in response to tactile feedback in the insertion force, adjust the height of the first elongate member 102 to a desired height above the golf ball 126 placed under the first elongate member 102.

Figure 3:
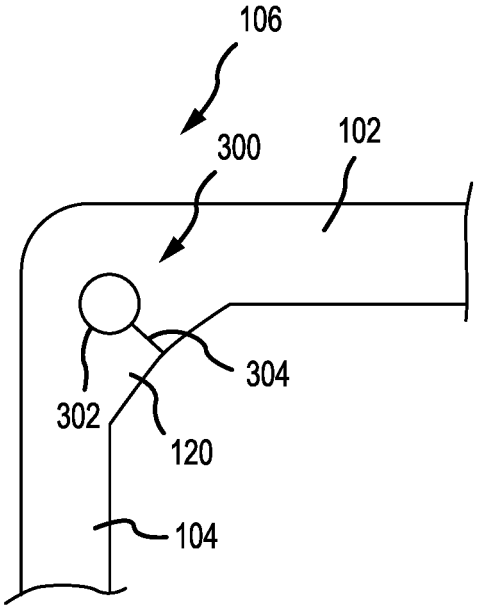
FIG. 3 illustrates a junction of a golf swing training device, in accordance with various embodiments.

In various embodiments, and with additional reference to FIG. 3, junction 106 is illustrated as including a frangibility feature 300. In various embodiments, the frangibility feature 300 may include a cutout portion 302 and a shear line 304. The shear line 304 may extend from the outer diameter of the cutout portion 302 through the web portion 120. In various embodiments the cutout portion 302 may extend fully through the junction 106. In various embodiments, the cutout portion 302 may partially penetrate the junction 106. In various embodiments, the shear line 304 may be a cut through the full thickness of the web portion 120. In various embodiments, the shear line 304 may be a partial-thickness cut through the web portion 120. The frangibility feature 300 may be configured to selectively weaken the resistance of junction 106 to impact forces transmitted to the junction 106 via the first elongate member 102. In response to applying an impact force (such as, for example, as may be generated by a strike from a golf club head or golf club shaft) to the first elongate member 102, the first elongate member may transmit the impact force to the frangibility feature 300. In response to receiving the impact force at the frangibility feature 300, the impact force may tend to be amplified or transformed to cause shearing between the first elongate member 102 and the second elongate member 104. In response to shearing at the frangibility feature 300, the first elongate member 102 may separate from the junction 106 and depart on a trajectory driven by the impact force. In this regard, by observation of the departing first elongate member 102, the swing training device 100 may tend to provide instantaneous feedback regarding the user's swing. For example, that the user's swing is topping the golf ball 126.

Figure 4:
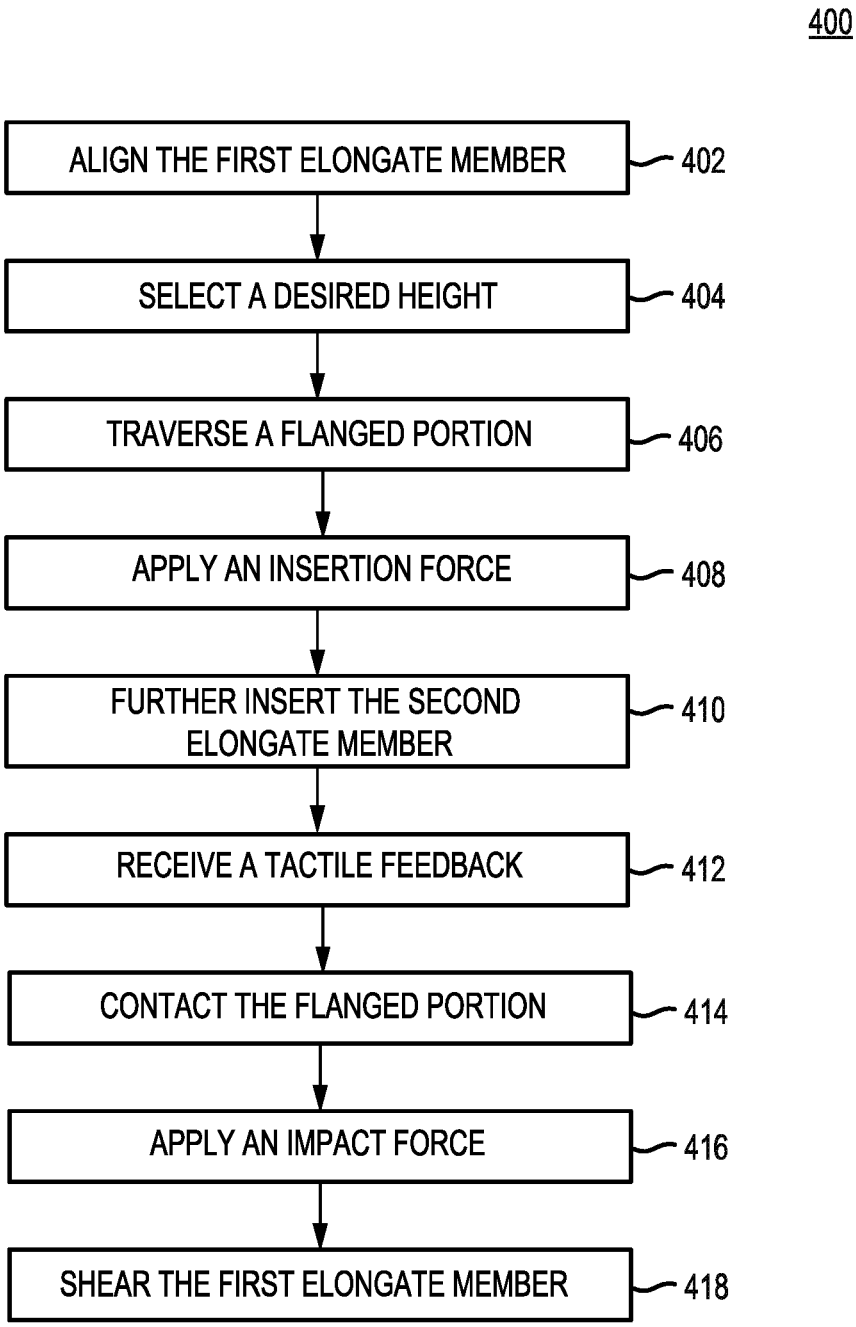
FIG. 4 illustrates a method of providing golf swing feedback, in accordance with various embodiments.

In various embodiments and with reference now to FIG. 4, a method 400 of providing golf swing feedback may include aligning the first elongate member 102 of a swing training device 100 above the golf ball 126 (step 402). Method 400 may include selecting a desired height of the first elongate member 102 above the golf ball 126 (step 404). In various embodiments, method 400 may include traversing flanged portion 116 along the second elongate member 104 (step 406). Method 400 includes applying an insertion force to the second the second elongate member 104 the swing training device 100 and, in response, inserting the second elongate member 104 below a substrate (for example, the earth, as represented by ground level 114) (step 408). Method 400 may include further inserting the second elongate member 104 until the desired height of the first elongate member 102 above the golf ball 126 is reached (step 410).

In various embodiments, method 400 includes receiving a tactile feedback from the swing training device 100 and removing the insertion force in response to the tactile feedback (step 412). In various embodiments, method 400 includes removing the insertion force in response to visual feedback such as, for example, observations of markings 122. In various embodiments, the method includes contacting the flanged portion 116 with the substrate (e.g., ground level 114) and removing the insertion force in response to the contact (step 414). Method 400 may include applying an impact force to the first elongate member 102 (step 416). In various embodiments, method 400 includes transmitting the impact force to the junction 106 and, in response, shearing the first elongate member 102 from the junction 106 (step 418).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosures.

The scope of the disclosures is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiment Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A golf swing training device, comprising:

a first elongate member and a second elongate member each coupled at and extending orthogonally from a junction, wherein the second elongate member is shorter than the first elongate member, and wherein a distal end of the second elongate member is sharply tapered to a point, wherein the junction includes a frangibility feature, wherein in response to applying an impact force to the first elongate member, the first elongate member is separated from the junction with the second elongate member by shearing at the frangibility feature.

2. The golf swing training device of claim 1, wherein the ratio of the length of the first elongate member to the second elongate member is about 1:1.2.

3. The golf swing training device of claim 1, wherein an interior angle defined by an intersection between the center lines of first elongate member and the second elongate member is between 85° and 95°.

4. The golf swing training device of claim 1, further comprising a flanged portion projecting radially from the second elongate member.

5. The golf swing training device of claim 4, wherein the flanged portion includes a frustoconical portion.

6. The golf swing training device of claim 4, wherein the flanged portion is removable.

7. The golf swing training device of claim 1, wherein the second elongate member comprises a detent.

8. The golf swing training device of claim 1, wherein the junction includes a web portion extending between the first elongate member and the second elongate member.

9. The golf swing training device of claim 1, wherein the frangibility feature includes at least one of a cutout portion or a shear line.

10. A method of providing golf swing feedback, comprising:

aligning a first elongate member of a swing training device above a golf ball;

selecting a desired height of the first elongate member above the golf ball;

applying an insertion force to a second elongate member of the swing training device and, in response, inserting a distal end of the second elongate member below a substrate;

removing the insertion force in response to at least one of a tactile feedback, a visual feedback, or contacting a flanged portion with the substrate; and applying an impact force to the first elongate member and, in response to the impact force, shearing the first elongate member from a junction between the first elongate member and the second elongate member.

* * * * *